US007131488B2

(12) United States Patent
Ozaki

(10) Patent No.: US 7,131,488 B2
(45) Date of Patent: Nov. 7, 2006

(54) HEAT EXCHANGER MODULE

(75) Inventor: Tatsuo Ozaki, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/940,878

(22) Filed: Sep. 14, 2004

(65) Prior Publication Data

US 2005/0072561 A1 Apr. 7, 2005

(30) Foreign Application Priority Data

Oct. 1, 2003 (JP) ..... 2003-343130

(51) Int. Cl.
*F28D 1/053* (2006.01)

(52) U.S. Cl. ..... 165/140; 165/149

(58) Field of Classification Search ..... 165/140, 165/135

See application file for complete search history.

(56) References Cited

U.S. PATENT DOCUMENTS 4,651,816 A * 3/1987 Struss et al. ..... 165/140

6,619,379 B1 * 9/2003 Ambros et al. ..... 165/140

FOREIGN PATENT DOCUMENTS

EP 0 859 209 A1 8/1998

GB 2262600 A * 6/1993 ..... 165/140

* cited by examiner

*Primary Examiner*—Leonard R. Leo
(74) *Attorney, Agent, or Firm*—Harness, Dickey & Pierce, PLC

(57) ABSTRACT

A heat exchanger module includes a first heat exchanger disposed at a downstream air side of second and third heat exchangers. In the heat exchanger module, walls are formed in reinforcement plates of the second and third heat exchangers, to be approximately perpendicular to a cooling air flow direction. Further, communication holes through which air passes are provided in the walls of the reinforcement plates. Accordingly, a sufficient amount of air for heat exchange can be supplied to the first heat exchanger, while the second and third heat exchangers can be reinforced enough by the reinforcement plates.

11 Claims, 4 Drawing Sheets

HEAT EXCHANGER MODULE

CROSS REFERENCE TO RELATED APPLICATION

This application is based on Japanese Patent Application No. 2003-343130 filed on Oct. 1, 2003, the disclosure of which is incorporated herein by reference.

FIELD OF THE INVENTION

The present invention relates to a heat exchanger module including plural heat exchangers.

BACKGROUND OF THE INVENTION

When plural heat exchangers are arranged in a line with respect to an air flow direction (for example, referring to EP 859209 (corresponding to JP-A-10-111086)), an insulation gap is provided between a first heat exchanger core and a second heat exchanger core by plates disposed parallel to the air flow direction between the two heat exchanger cores. However, in this document, because the plates are disposed parallel to the air flow direction, it is impossible to increase quadratic moments of plate cross sections perpendicular to an axis parallel to the air flow direction. Therefore, the heat exchanger cores cannot be reinforced enough by the plates.

In contrast, if the plates are disposed nearly perpendicular to the air flow direction between the two heat exchanger cores, it is possible to increase quadratic moments of plate cross sections perpendicular to the axis parallel to the air flow direction without increasing a thickness of the plates. In this case, it is possible to reinforce enough the heat exchanger cores by the plates. However, a new problem as following is caused.

When the plates are disposed nearly perpendicular to the air flow direction, air cannot pass through portions where the plates are disposed between the two heat exchanger cores. Accordingly, if other heat exchanger is disposed at a downstream air side of the two heat exchanger cores, the other heat exchanger cannot be provided with enough air necessary for a heat exchange and cannot perform a sufficient heat exchange.

SUMMARY OF THE INVENTION

In view of the above-described problems, it is an object of the present invention to provide a heat exchange module having plural heat exchanger, where a sufficient amount of air is supplied to a heat exchanger at a downstream air side while heat exchanger cores at an upstream air side are reinforced.

According to the present invention, a heat exchanger module includes a first heat exchanger, a second heat exchanger disposed at an upstream air side of the first heat exchanger, and a third heat exchanger disposed at the upstream air side of the first heat exchanger and arranged in a line with the second heat exchanger with respect to an air flow direction. The first heat exchanger includes a plurality of tubes in which a fluid flows and a plurality of fins disposed on outside surfaces of the tubes. The second heat exchanger includes a heat exchanger core that has a plurality of tubes in which a fluid flows and a plurality of fins disposed on outside surfaces of the tubes, and a reinforcement plate that reinforces the heat exchanger core and includes a wall member intersecting with an air flow. Further, the third heat exchanger includes a heat exchanger core that has a plurality of tubes in which a fluid flows and a plurality of fins disposed on outside surfaces of the tubes, and a reinforcement plate that reinforces the heat exchanger core and includes a wall member intersecting with the air flow. In the heat exchanger module, at least one of the wall members of the reinforcement plates of the second heat exchanger and the third heat exchanger has a communication hole through which air flows. Accordingly, a sufficient amount of air for performing heat exchange can be supplied to the first heat exchanger because the communication hole is provided. Moreover, because the reinforcement plates are provided with the wall members that are approximately perpendicular to a cooling air flow direction, it is possible to increase quadratic moments on a cross section perpendicular to the air flow direction even when a thickness of the reinforcement plate is not increased. Therefore, the heat exchanger cores can be sufficiently reinforced by the reinforcement plates.

For example, at least one of the reinforcement plates has an approximate U-shape in a cross section parallel to the air flow direction, to be opened in a direction perpendicular to the air flow direction.

Preferably, a ratio of a projection area of the communication hole projected on a plane perpendicular to the air flow direction to a projection area of the reinforcement plate having the communication hole projected on the plane perpendicular to the air flow direction is in a range between 0.5 and 0.9. In this case, a sufficient amount of cooling air can be supplied to the first radiator at the downstream air side, while strength of the reinforcement plate can be ensured.

Alternatively, a ratio of S1 to S2 is set larger than C, in which S1 indicates a projection area of a portion between the heat exchanger core of the second heat exchanger and the heat exchanger core of the third heat exchanger, projected on a plane perpendicular to the air flow direction; S2 indicates a projection area of an air passage including the communication hole, which is between the heat exchanger core of the second heat exchanger and the heat exchange core of the third heat exchanger, projected on the plane perpendicular to the air flow direction; and C indicates a proportion of the projection area of the air passage to a total projection area of the heat exchanger cores projected on the plane perpendicular to the air flow direction.

More preferably, at least one of the reinforcement plates includes a plurality of the communication holes partitioned from each other. In this case, the strength of the reinforcement plate can be effectively increased while a sufficient amount of air can be supplied to the first heat exchanger at the downstream air side.

For example, the first heat exchanger is disposed to be separated from one of the second heat exchanger and the third heat exchanger by a distance equal to or below 20 mm. In this case, the size of the heat exchanger module can be reduced while the present invention can be effectively used. The present invention can be more effective when the reinforcement plates of the second and third heat exchangers are disposed adjacent to each other in an arrangement direction of the second and third heat exchangers.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS (First Embodiment)

In the first embodiment, a heat exchanger module of the present invention is typically used for a cooling device of a hybrid automobile.

Figure 2:
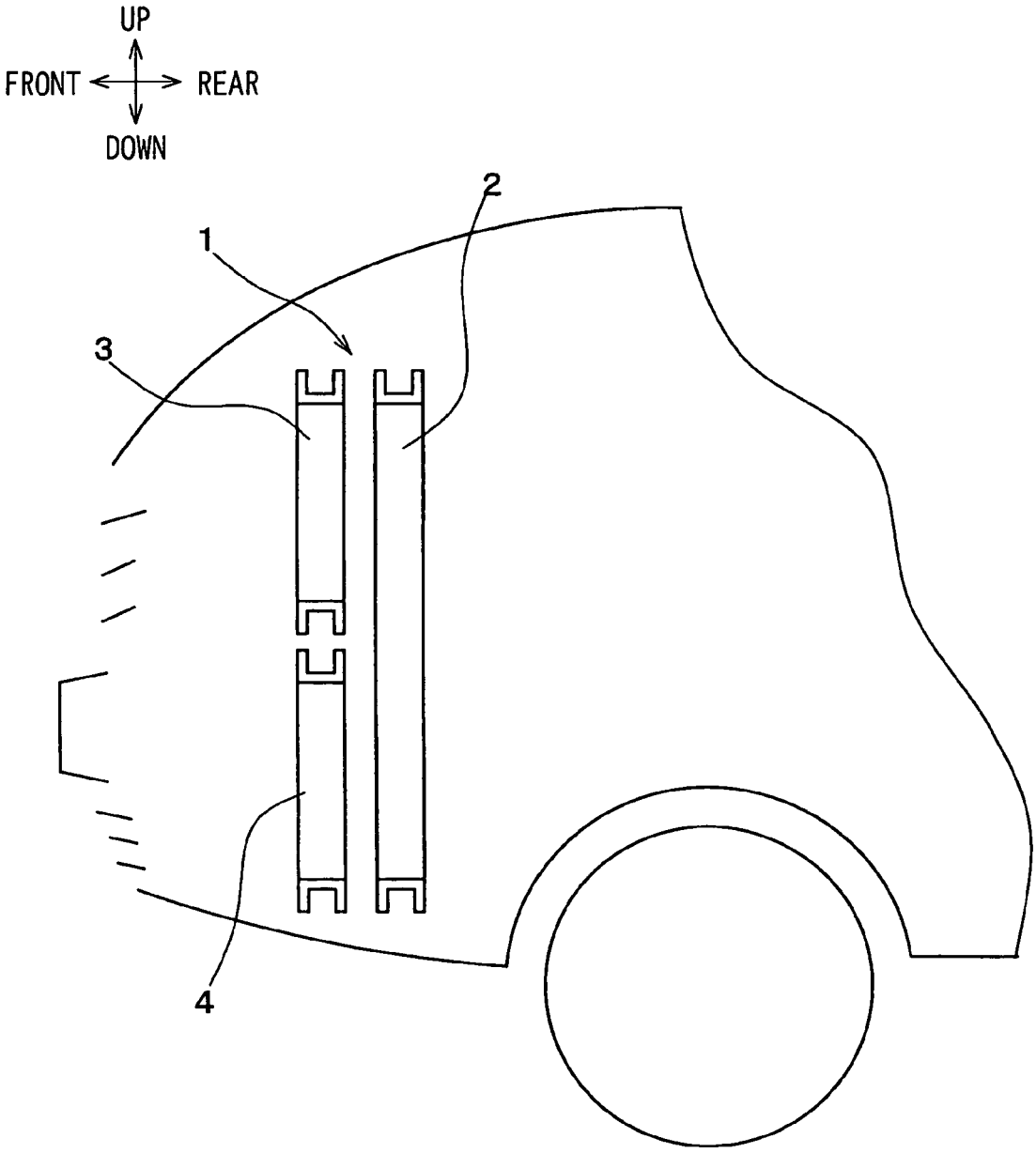
FIG. 2 is a schematic view showing a mounting state of the heat exchanger module in a vehicle, according to the first embodiment.

As shown in FIG. 2, the heat exchanger module 1 in this embodiment includes a first radiator 2, a second radiator 3 and an exterior heat exchanger 4 of a vehicle air-conditioning device (a vapor compression refrigerator) and the like. The first radiator 2 exchanges heat between air and an engine-cooling water that cools an internal-combustion engine for traveling (not shown). The second radiator 3 exchanges heat between air and an inverter-cooling water that cools an electric motor (not shown) and a driving circuit. The driving circuit drives an inverter circuit and the like which control a driving electric current of the electric motor.

Furthermore, at an upstream side of a cooling air flow of the first radiator 2, both the second radiator 3 and the exterior heat exchanger 4 are arranged in a line, and are disposed in parallel with respect to the cooling air flow. In this embodiment, the second radiator 3 is disposed at an upper side of the exterior heat exchanger 4.

Figure 1:
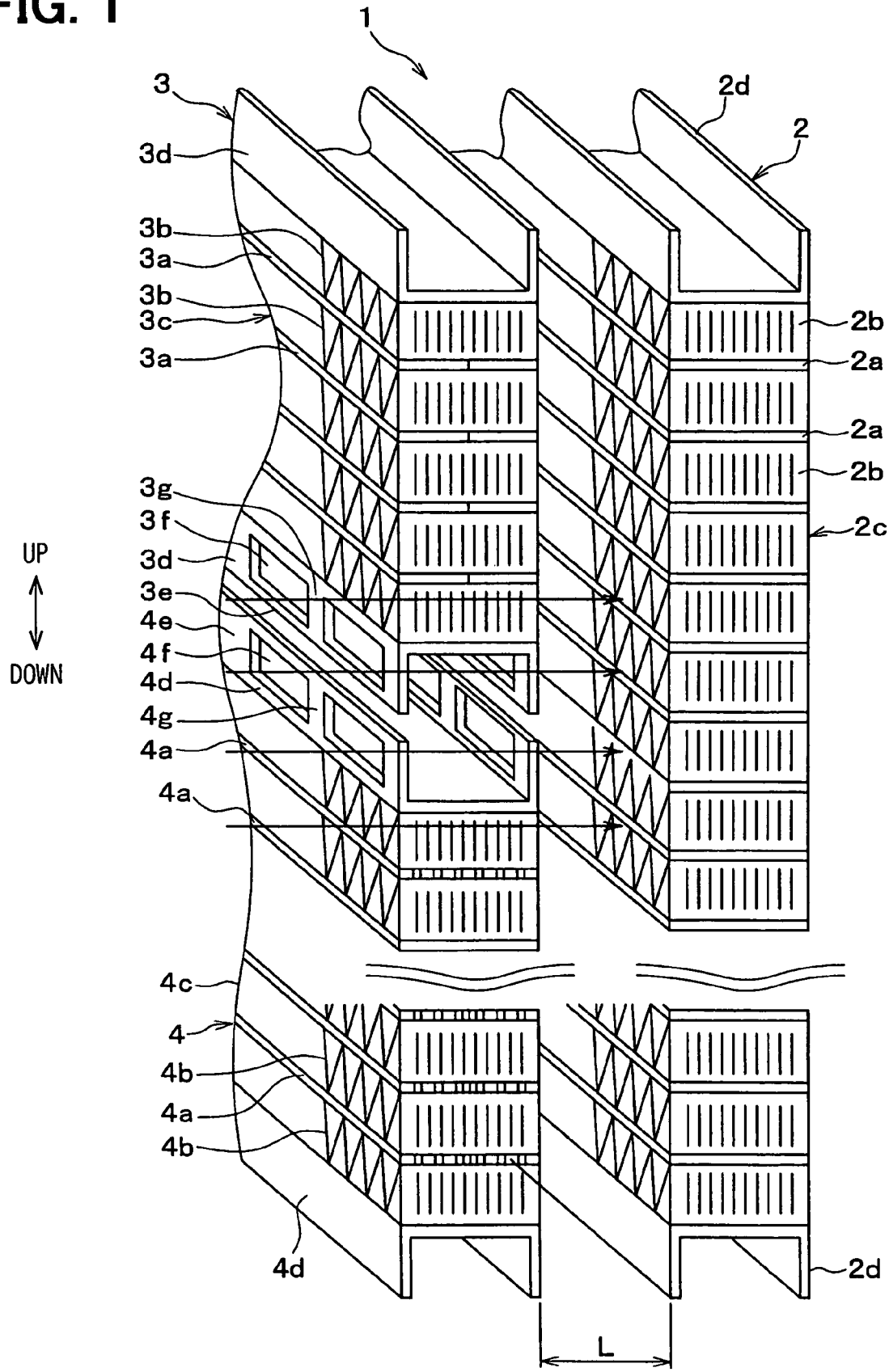
FIG. 1 is a perspective view showing characteristics of a heat exchanger module according to a first embodiment of the present invention.

As shown in FIG. 1, the first radiator 2 is constructed with a heat exchanger core 2*c*, a header tank (not shown) and reinforcement plates 2*d* and the like. The heat exchanger core 2*c* includes multiple flat tubes 2*a* where the engine-cooling water flows, and multiple fins 2*b* that are joined to flat surfaces of the tubes 2*a*. The header tank communicates with the multiple tubes 2*a* at two end sides of a longitudinal direction of the tubes 2*a*. The reinforcement plates 2*d* are disposed at two end portions of the heat exchanger core 2*c* and extend in a direction parallel to the longitudinal direction of the tubes 2*a* to reinforce the heat exchanger core 2*c*.

In this embodiment, the reinforcement plate 2*d* is formed by a pressing to have an approximate U-shape in cross section perpendicular to a longitudinal direction of the reinforcement plate 2*d*. The U-shaped cross section is opened in a direction (i.e., vertical direction) perpendicular to the cooling air flow direction (i.e., vehicle front-rear direction) and it defines a pair of legs extending from a base. Furthermore, because all the tubes 2*a*, the fins 2*b*, the header tank and the reinforcement plates 2*d* are all made of metal such as aluminum allow and the like, they are integrally joined by brazing or soldering.

Here, the brazing or soldering is a bonding technology where a basic material is not melted by using a brazing metal or a solder as described in, for example, Connection and Bonding Technology (Tokyo Electrical Machinery University Publishing Company).

Generally, the brazing is referred when the joining is performed by using a metal material with a melting point beyond 450° C., and this metal material is called the brazing material. Then, the soldering is referred when the joining is performed by using a metal material with a melting point below 450° C., and this metal material is called the solder.

Furthermore, the second radiator 3 has a structure similar to that of the first radiator 2. Specifically, the second radiator 3 is constructed with a heat exchanger core 3*c*, a header tank (not shown) and reinforcement plates 3*d* and the like. The heat exchanger core 3*c* includes multiple flat tubes 3*a* where the inverter-cooling water flows, and multiple fins 3*b* joined to flat surfaces of the tubes 3*a*. The header tank communicates with the multiple tubes 3*a* at two end sides of a longitudinal direction of the tubes 3*a*. The reinforcement plates 3*d* are disposed at two end portions of the heat exchanger core 3*c* and extend in a direction parallel to the longitudinal direction of the tubes 3*a* to reinforce the heat exchanger core 3*c*. In this embodiment, because all the tubes 3*a*, the fins 3*b*, the header tank and the reinforcement plates 3*d* are made of metal such as aluminum alloy and the like, they are integrally bonded by the brazing or soldering.

Moreover, the exterior heat exchanger 4 has a structure similar to the first radiator 2. Specifically, the exterior heat exchanger 4 is constructed with a heat exchanger core 4*c*, a header tank (not shown) and reinforcement plates 4*d* and the like. The heat exchanger core 4*c* includes multiple flat tubes 4*a* where a refrigerant flows, and multiple fins 4*b* joined to flat surfaces of the tubes 4*a*. The header tank communicates with the multiple tubes 4*a* at two end sides of a longitudinal direction of the tubes 4*a*. The reinforcement plates 4*d* are disposed at two end portions of the heat exchanger core 4*c* and extend in a direction parallel to the longitudinal direction of the tubes 4*a* to reinforce the heat exchanger core 4*c*. In this embodiment, because all the tubes 4*a*, the fins 4*b*, the header tank and the reinforcement plates 4*d* are made of metal such as aluminum alloy and the like, they are integrally bonded by the brazing or soldering.

In the first embodiment, the longitudinal direction of the tubes 2*a*, the tubes 3*a* and the tubes 4*a* is positioned in a horizontal direction. Furthermore, wave-like corrugate fins having louvers, which increase a heat transmission rate by disordering the air flow, are used as the fins 2*b*, the fins 3*b* and the fins 4*b*.

Plural communication holes 3*f* and 4*f* define means for bypassing air around second radiator 3 and heat exchanger 4, are provided in walls 3*e* and 4*e* of the reinforcement plates 3*d* and 4*d*. The walls 3*e* are opposite to each other in the reinforcement plate 3*d*, and the wall 4*e* are opposite to each other in the reinforcement plate 4*d*. The walls 3*e* and 4*e* are provided in the reinforcement plates 4*d* and 3*d* to be perpendicular to the cooling air flow direction.

In this embodiment, a total cross section area and number of the communication holes 3*f* are set to make a ratio (sf/sd) of Sf to Sd in a range between 0.5 and 0.9. Sf indicates a projection area of the communication holes 3*f*, projected on a plane perpendicular to the cooling air flow direction, and Sd indicates a projection area of the reinforcement plate 3*d* provided with the communication holes 3*f*, projected on the plane perpendicular to the cooling air flow direction.

Similarly, a total cross section area and number of the communication holes 4*f* are set to make a ratio (Sf/Sd) of Sf to Sd in the range between 0.5 and 0.9. Sf indicates a projection area of the communication holes 4*f* projected on the plane perpendicular to the cooling air flow direction, and Sd indicates a projection area of the reinforcement plate 4*d* provided with the communication holes 4*f*, projected on the plane perpendicular to the cooling air flow direction.

In this embodiment, the second radiator 3 and the exterior heat exchanger 4 are mechanically connected by a bracket (not shown) that is provided between the reinforcement plate 3*d* and the reinforcement plate 4*d*.

Advantages of this embodiment will be described as following.

In this embodiment, cooling air is sufficiently supplied to the first radiator 2 located at the downstream side of the cooling air flow of the second radiator 3 and the exterior heat exchanger 4, because the communication holes 3*f* and 4*f*, through which air passes, are provided in the walls 3*e* and 4*e* that are approximately perpendicular to the cooling air flow direction in the reinforcement plates 3*d* and 4*d*.

Moreover, because the reinforcement plates 3*d* and 4*d* are constructed with the walls 3*e* and 4*e* that are positioned between the heat exchanger cores 3*c* and 4*c* to be approximately perpendicular to the cooling air flow direction, quadratic moments on the plate cross sections, which are perpendicular to the axis parallel to the cooing air flow direction, can be increased while a thickness of the reinforcement plates 3*d* and 4*d* is not increased. Therefore, the heat exchanger cores 3*c* and 4*c* can be reinforced enough.

However, because the communication holes 3*f* and 4*f* are provided in the walls 3*e* and 4*e* which are located in the reinforcement plates 3*d* and 4*d*, a bending rigidity of the reinforcement plates 3*d* and 4*d*, and a buckling strength of the walls 3*e* and 4*e* may be greatly decreased.

In this embodiment, partition walls 3*g* and 4*g* are provided (referring to FIG. 1) in the walls 3*e* and 4*e* of the reinforcement plates 3*d* and 4*d* to partition adjacent communication holes 3*f* and adjacent communication holes 4*f*. Therefore, a large decrease of the bending rigidity and the buckling strength due to the communication holes 3*f* and 4*f* can be restricted.

Accordingly, before the brazing of the second radiator 3 and the exterior heat exchanger 4, when the members of the second radiator 3 and the exterior heat exchanger 4, such as the tubes 3*a* and 4*a* and the reinforcement plates 3*d* and 4*d* are temporarily fixed by using a jig such as a wire wound around the members, deformations of the reinforcement plate 3*d* and 4*d* can be restricted.

Furthermore, in this embodiment, when the ratio Sf/Sd is in the range between 0.5 and 0.9, the strength of the reinforcement plates 3*d* and 4*d* is sufficiently increased, while the amount of the cooling air flowing to the first radiator 2 at the downstream side is ensured.

If a distance L between the first radiator 2 and the second radiator 3 or the exterior heat exchanger 4 (referring to FIG. 1) becomes large enough, the cooling air can be sufficiently supplied to the first radiator 2 even when the communication holes 3*f* and 4*f* are not provided. However, an increase of the distance L can deteriorate a mounting on the vehicle. Generally, the distance L is limited below 20 mm in this embodiment.

(Second Embodiment)

In the above-described first embodiment, the total cross section area and number of the communication holes 3*f*, 4*f* are set so that the ratio (Sf/Sd) of Sf to Sd is in the range between 0.5 and 0.9. In the second embodiment, the total cross section area and number of the communication holes 3*f*, 4*f* is set also considering a gap between the reinforcement plate 3*d* and the reinforcement plate 4*d*.

Figure 3:
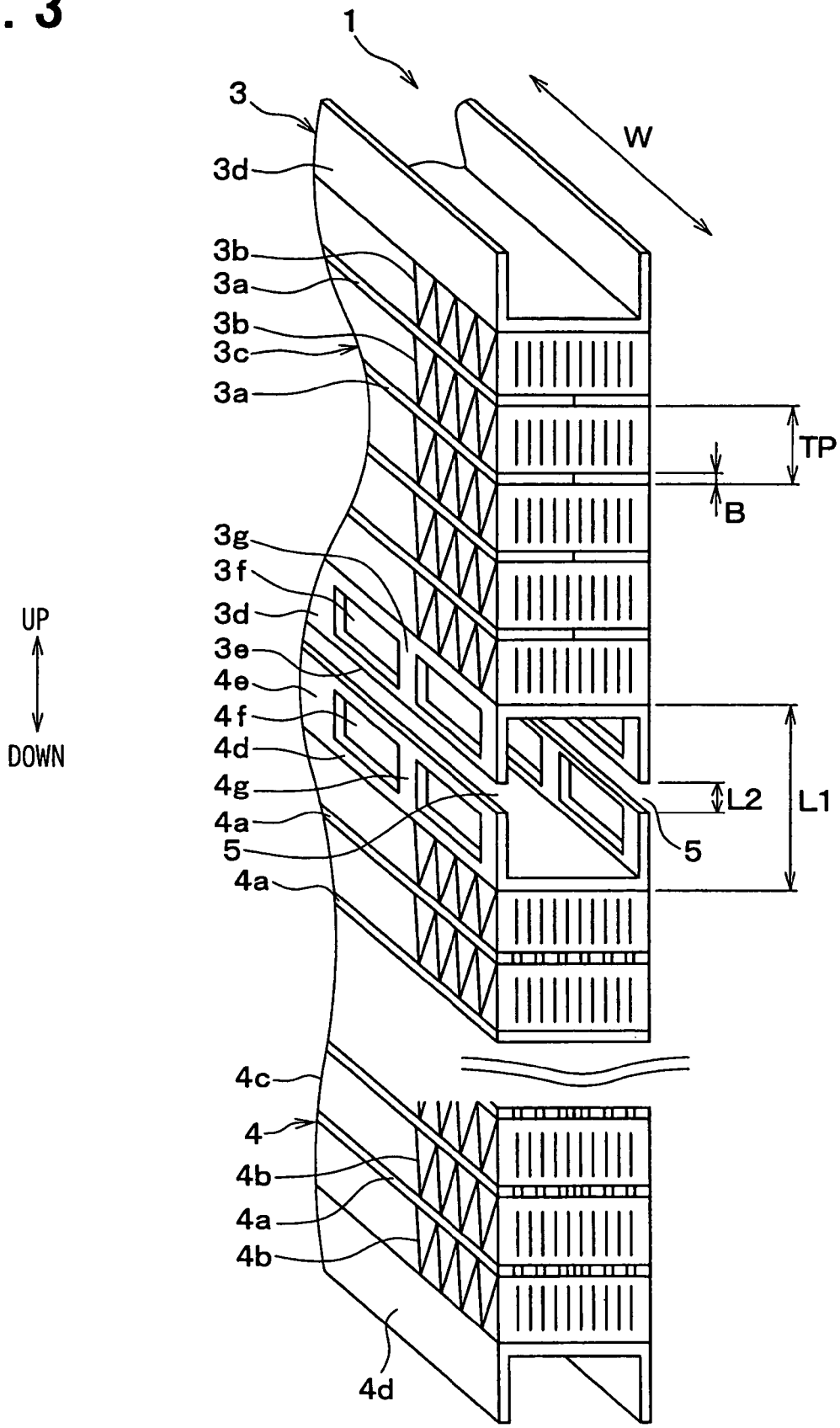
FIG. 3 is a perspective view showing characteristics of a heat exchanger module according to a second embodiment of the present invention.

Here, S1 indicates a projection area of a portion between the heat exchanger core 3*c* of the second radiator 3 and the heat exchanger core 4*c* of the exterior heat exchanger 4, projected on the plane perpendicular to the cooling air flow direction. S2 indicates a projection area of an air passage including the communication holes 3*f* and 4*f*, between the heat exchanger core 3*c* of the second radiator 3 and the heat exchanger core 4*c* of the exterior heat exchanger 4, projected on the plane perpendicular to the cooling air flow direction. That is, the air passage is composed of a gap 5 (referring to FIG. 3) between the reinforcement plates 3*d* and 4*d*, and the communication holes 3*f* and 4*f*. C indicates a proportion of an air passage projection area of each of the cores 4*c* and 4*c* to a total projection area of each of the heat exchanger core 3*c* and 4*c*, projected on the plane perpendicular to the cooling air flow direction. In this embodiment, a ratio (S2/S1) of S1 to S2 is set larger than C. S2, S1 and C will be expressed by following expressions.

$$S1=L1\times W$$

$$S2=L2\times W+\Sigma s$$

$$C=[(T_p-B)\times W]/(T_p\times W)=(T_p-B)/T_p$$

wherein, L1 indicates a distance between the heat exchanger core 3*c* and the heat exchanger core 4*c* (referring to FIG. 3), L2 indicates a distance between the reinforcement plate 3*d* and the reinforcement plate 4*d* (referring to FIG. 3), W indicates a longitudinal dimension of the tubes 3*a* or the tubes 4*a* (referring to FIG. 3), $T_p$ indicates a pitch dimension between the tubes 3*a* or the tubes 4*a* (referring to FIG. 3), B indicates a thickness dimension of the tubes 3*a* or the tubes 4*a* (referring to FIG. 3), s indicates a cross section area of the communication holes 3*f* or the communication holes 4*f* and Σs indicates a total cross section area of the communication holes 3*f* and the communication holes 4*f*.

In this embodiment, because the pitch dimension between the tubes 3*a* is the same as that between the tubes 4*a* and the thickness dimension of the tubes 3*a* is the same as that of the tube 4*a*, either them can be used. If the dimensions of the tubes 4*a*, 3*a* are different, a large one is selected as the pitch dimension and a small one is selected in the thickness dimension.

When $L2>L1\times(T_p-B)/T_p$, a sufficient amount of cooling air can be supplied to the first radiator 2 even when the communication holes 3*f* and 4*f* are not provided.

Third Embodiment

This embodiment relates to a junction portion structure between the second radiator 3 and the exterior heat exchanger 4.

Figure 4A:
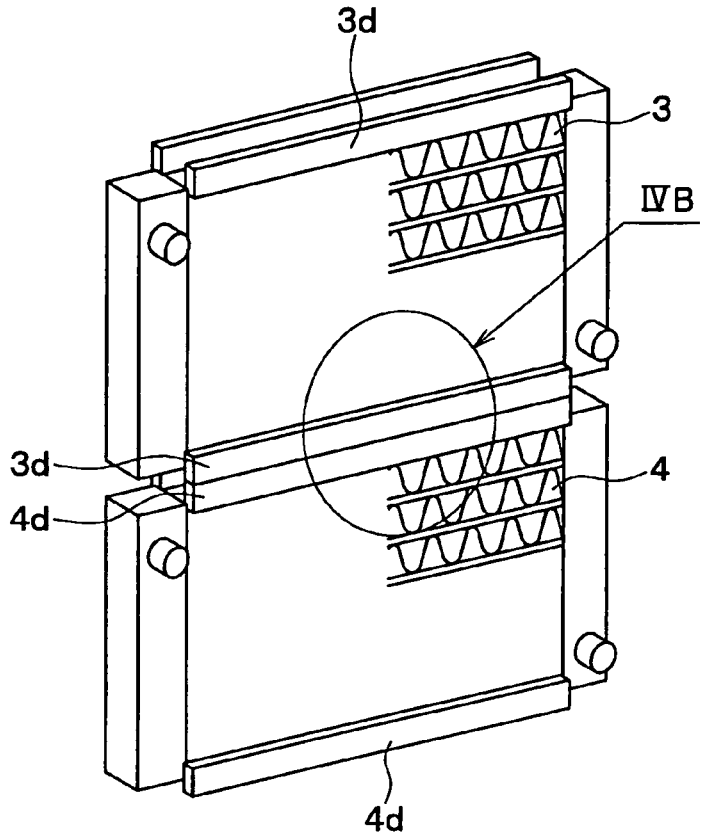
FIG. 4A is a perspective view showing characteristics of a heat exchanger module according to a third embodiment of the present invention and FIG. 4B is a partial enlarged schematic sectional view of the portion IVB in FIG. 4A.
Figure 4B:
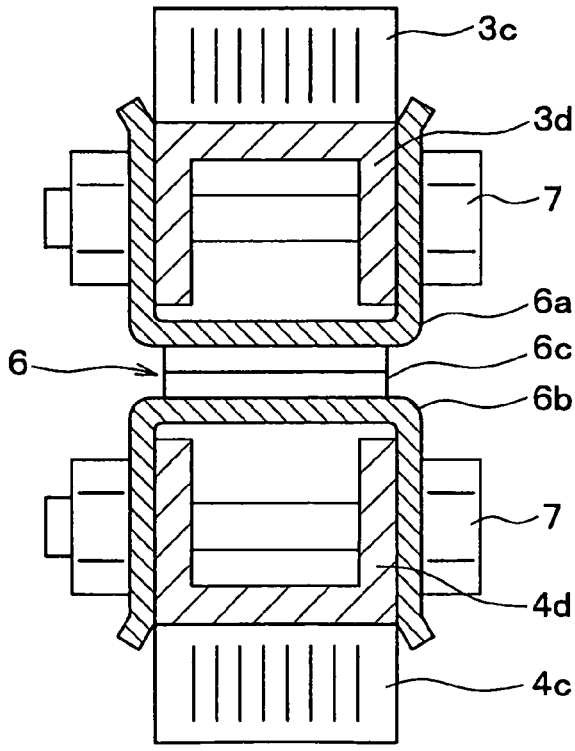

As shown in FIG. 4B, a bracket 6 made of metal (cold rolled steel in this embodiment) is constructed with a U-shape portion 6*a* which pinches the reinforcement plate 3*d*, a U-shape portion 6*b* which pinches the reinforcement plate 4*d* and a connection portion 6*c* which connects the U-shape portion 6*a* and the U-shape portion 6*b*. The bracket 6 is fixed to the reinforcement plate 3*d* and the reinforcement plate 4*d* by using a fastening member such as bolts 7 and the like. Thus, the reinforcement plate 3*d* is readily connected to the reinforcement plate 4*d*, when the second radiator 3 and the exterior heat exchanger 4 are connected as shown in FIG. 4A.

Moreover, the bracket 6 is provided without covering the communication holes 3*f* and 4*f*.

In the third embodiment, the other parts are similar to those of the above-described first or second embodiment.

Other Embodiment

Although the present invention has been fully described in connection with the preferred embodiments thereof with reference to the accompanying drawings, it is to be noted that various changes and modifications will become apparent to those skilled in the art.

For example, in the above-described embodiments, the total cross section area and number of the communication holes 3*f* can be set so that an average ratio (Sf/Sd) of Sf to Sd in both the second radiator 3 and the exterior heat exchanger 4 is in the range between 0.5 and 0.9. Alternately, the total cross section area and number of the communication holes 4*f* can be also set so that the average ratio (Sf/Sd) of Sf to Sd in both the second radiator 3 and the exterior heat exchanger 4 is in the range between 0.5 and 0.9.

For example, the ratio (Sf/Sd) of the second radiator 3 can not be in the range between 0.5 and 0.9, when an average value of the ratio (Sf/Sd) of the second radiator 3 and the ratio (Sf/Sd) of the exterior heat exchanger 4 is in the range between 0.5 and 0.9.

In the above-described embodiments, the communication holes 3*f* and 4*f* are provided in the reinforcement plates 3*d* and 4*d*. However, the present invention is not limited to this. For example, the communication holes can be provided only in either of the reinforcement plates 3*d* and 4*d*.

In the above-described embodiments, the first radiator 2 is used as a first heat exchanger, the second radiator 3 for cooling the inverter is used as a second heat exchanger, and the exterior heat exchanger 4 of the air-conditioning device is used as a third heat exchanger. However, the present invention is not limited to this. For example, an oil cooler can be used as the second heat exchanger. Further, the arrangement positions of the first, second and third heat exchangers can be changed.

In the above-described embodiments, the reinforcement plates 3*d* and 4*d* are disposed at two end portions of the heat exchanger core 3*c* and 4*c*, respectively. However, the present invention is not limited to this. The reinforcement plates 3*d* and 4*d* can be only disposed at the end potions adjacent to each other in an arrangement direction of the second radiator 3 and the exterior heat exchanger 4.

Moreover, in the above-described embodiments, each of the reinforcement plates 3*d* and 4*d* is formed to have the approximate U-shape in the cross section. However, when the reinforcement plates 3*d* and 4*d* have a wall member that crosses with the air flow direction, the shape of the reinforcement plates 3*d* and 4*d* can be changed.

Such changes and modifications are to be understood as being within the scope of the present invention as defined by the appended claims.

What is claimed is:

1. A heat exchanger module for performing heat exchange with air, comprising:

a first heat exchanger including a plurality of tubes in which a fluid flows and a plurality of fins disposed on outside surfaces of the tubes;

a second heat exchanger disposed at an upstream air side of the first heat exchanger, the second heat exchanger including a heat exchanger core that has a plurality of tubes in which a fluid flows and a plurality of fins disposed on outside surfaces of the tubes, and a first reinforcement plate that reinforces the heat exchanger core of the second heat exchanger and includes a wall member intersecting with an air flow; and a third heat exchanger disposed at the upstream air side of the first heat exchanger and arranged in a line with the second heat exchanger with respect to an air flow direction, the third heat exchanger being separate from the second heat exchanger and including:

a heat exchanger core that has a plurality of tubes in which a fluid flows and a plurality of fins disposed on outside surfaces of the tubes, and a second reinforcement plate that reinforces the heat exchanger core of the third heat exchanger and includes a wall member intersecting with the air flow, wherein the wall member of the first reinforcement plate has a first communication hole defining first means for bypassing air around the second and third heat exchangers to the first heat exchanger; and the wall member of the second reinforcement plates has a second communication hole defining second means for allowing air to flow around the second and third heat exchangers to the first heat exchanger.

2. The heat exchanger module according to claim 1, wherein at least one of the first and second reinforcement plates has an approximate U-shape in a cross section parallel to the air flow direction, to be opened in a direction perpendicular to the air flow direction.

3. The heat exchanger module according to claim 1, wherein a ratio of a projection area of the first communication hole projected on a plane perpendicular to the air flow direction to a projection area of the reinforcement plate having the first communication hole projected on the plate perpendicular to the air flow direction is in a range between 0.5 and 0.9.

4. The heat exchanger module according to claim 1, wherein a ratio of S1 to S2 is set larger than C, in which S1 indicates a projection area of a portion between the heat exchanger core of the second heat exchanger and the heat exchanger core of the third heat exchanger, projected on a plane perpendicular to the air flow direction; S2 indicates a projection area of an air passage including the first communication hole, which is between the heat exchanger core of the second heat exchanger and the heat exchange core of the third heat exchanger, projected on the plane perpendicular to the air flow direction; and C indicates a proportion of the projection area of the air passage to a total projection area of the heat exchanger cores projected on the plane perpendicular to the air flow direction.

5. The heat exchanger module according to claim 1, wherein the wall member of the first reinforcement plate includes a plurality of the communication holes partitioned from each other to define the first bypassing means.

6. The heat exchanger module according to claim 1, wherein the first heat exchanger is disposed to be separated from one of the second heat exchanger and the third heat exchanger by a distance equal to or below 20 mm.

7. The heat exchanger module according to claim 1, wherein the first and second reinforcement plates are disposed adjacent to each other in an arrangement direction of the second and third heat exchanger.

8. The heat exchanger module according to claim 1, wherein the wall members of the first and second reinforcement plates each include a plurality of the communication holes partitioned from each other to define the first and second bypassing means.

9. The heat exchanger according to claim 1, wherein each of the first and second reinforcement plates has an approximate U-shape in a cross-section defining a pair of legs extending from a base, each of the pair of legs of the first reinforcement plate defining a portion of the first communication hole, each of the pair of legs of the second reinforcement plate defining a portion of the second communication hole.

10. The heat exchanger according to claim 1, wherein the first reinforcement plate has an approximate U-shape in a cross-section defining a pair of legs extending from a base, each of the pair of legs defining a portion of the first communication hole.

11. The heat exchanger according to claim 1, wherein the first reinforcement plate is separate from the second reinforcement plate.

* * * * *